US007995767B2

(12) United States Patent
Amada

(10) Patent No.: US 7,995,767 B2
(45) Date of Patent: Aug. 9, 2011

(54) SOUND SIGNAL PROCESSING METHOD AND APPARATUS

(75) Inventor: Tadashi Amada, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1442 days.

(21) Appl. No.: 11/476,024

(22) Filed: Jun. 28, 2006

(65) Prior Publication Data

US 2007/0005350 A1 Jan. 4, 2007

(30) Foreign Application Priority Data

Jun. 29, 2005 (JP) ..... 2005-190272

(51) Int. Cl.
*H04R 5/00* (2006.01)

(52) U.S. Cl. ..... 381/18; 381/17; 381/80

(58) Field of Classification Search ..... 381/1, 17–23, 381/80, 119; 700/94; 704/500–504; 369/4
See application file for complete search history.

(56) References Cited

U.S. PATENT DOCUMENTS 6,553,122 B1 * 4/2003 Shimauchi et al. ..... 381/66
7,299,190 B2 * 11/2007 Thumpudi et al. ..... 704/500
7,391,870 B2 * 6/2008 Herre et al. ..... 381/23
7,689,428 B2 * 3/2010 Takagi et al. ..... 704/501
7,702,407 B2 * 4/2010 Oh et al. ..... 700/94

FOREIGN PATENT DOCUMENTS

| | | |
|---|---|---|
| JP | 11-202894 | 7/1999 |
| JP | 2003-78988 | 3/2003 |
| JP | 2003-140686 | 5/2003 |
| JP | 2004-289762 | 10/2004 |
| WO | WO 02/18969 A1 | 3/2002 |

OTHER PUBLICATIONS

J.L. Flanagan, et al. "Spatially Selective Sound Capture for Speech and Audio Processing" Speech Communication, vol. 13 1993, pp. 207-222.

A. V. Oppenheim, et al. "Digital Signal Processing", Prentice Hall, 1975, pp. 519-524.

* cited by examiner

*Primary Examiner* — Xu Mei
(74) *Attorney, Agent, or Firm* — Oblon, Spivak, McClelland, Maier & Neustadt, L.L.P.

(57) ABSTRACT

A sound signal processing method includes calculating a difference between every few ones of input multiple channel sound signals to obtain a plurality of characteristic quantities each indicating the difference, selecting a weighting factor from a weighting factor dictionary containing a plurality of weighting factors of a plurality of channels corresponding to the characteristic quantities, weighting the sound signals by using the selected weighting factor, and adding the weighted input sound signals to generate an output sound signal.

33 Claims, 6 Drawing Sheets

SOUND SIGNAL PROCESSING METHOD AND APPARATUS

CROSS-REFERENCE TO RELATED APPLICATIONS

This application is based upon and claims the benefit of priority from prior Japanese Patent Application No. 2005-190272, filed Jun. 29, 2005, the entire contents of which are incorporated herein by reference.

BACKGROUND OF THE INVENTION

1. Field of the Invention

The present invention relates to a sound signal processing method for emphasizing a target speech signal of an input sound signal and outputting an emphasized speech signal, and an apparatus for the same.

2. Description of the Related Art

When a speech recognition technology is used in an actual environment, ambient noise has a large influence to a speech recognition rate. There are many noises such as engine sound, wind noise, sound of an oncoming car and a passing car and sounds of a car audio device in a car. These noises are mixed in a voice of a speaker, and input to a speech recognition system thereby causing to decrease the recognition rate greatly. As a method for solving a problem of such a noise is considered the use of a microphone array. The microphone array subjects the input sound signals from a plurality of microphones to signal processing to emphasize a target speech signal which is a voice of a speaker and outputs the emphasized speech signal.

There is well known an adaptive microphone array to suppress noise by turning the null at which the receiving sound sensitivity of the microphone is low to an arrival direction of noise automatically. The adaptive microphone array is designed under a condition (restriction condition) that a signal in a target sound direction is not suppressed generally. As a result, it is possible to suppress noise from the side of the microphone array without suppressing the target speech signal coming from the front direction thereof.

However, there is a problem of so-called reverberation that in an actual environment, the voice of the speaker who is in front of the microphone array is reflected by obstacles surrounding the speaker such as walls, and the voice components coming from various directions enter to the microphone. The reverberation is not considered in the conventional adaptive microphone array. As a result, when the adaptive microphone array is employed under the reverberation, there is a problem to have a phenomenon as referred to as "target signal cancellation" that the target speech signal which should be emphasized is improperly suppressed.

There is proposed a method for making it possible to avoid the problem of the target signal cancellation if the influence of the reverberation is known, that is, the transfer function from a sound source to a microphone is known. For example, J. L. Flanagan, A. C. Surendran and E. E. Jan, "Spatially Selective Sound Capture for Speech and Audio Processing", Speech Communication, 13, pp. 207-222, 1993 provides a method for filtering an input sound signal from a microphone with a matched filter provided by a transfer function expressed in a form of an impulse response. A. V. Oppenheim and R. W. Schafer, "Digital Signal Processing", Prentice Hall, pp. 519-524, 1975 provides a method for reducing reverberation by converting an input sound signal into a cepstrum and suppressing a higher-order cepstrum.

The method of J. L. Flanagan et al. has to know an impulse response beforehand, so that it is necessary to measure an impulse response in the environment in which the system is actually used. Because there are many elements such as a passenger and a load, opening and closing of a window, which influence transfer functions in a car, it is difficult to implement a method that such an impulse response must be known beforehand.

On the other hand, A. V. Oppenheim et al. utilize the tendency that a reverberation component is apt to appear at a higher term of the cepstrum. However, because the direct wave and the reverberation component are not quantized in perfection, how the reverberation component which is harmful to the adaptive microphone array can be removed depends upon a situation of the system.

A room of a car is so small that the reflection component concentrates on a short time range. Then a direct sound and reflected sounds are mixed and change a spectrum greatly. Therefore, the method using the cepstrum cannot separate between the direct wave and the reverberation component enough, so that it is difficult to avoid the target signal cancellation due to influence of the reverberation.

The conventional art described above has a problem not to be able to remove enough the reverberation component leading to the target signal cancellation of the microphone array in the small space in a car.

BRIEF SUMMARY OF THE INVENTION

An aspect of the present invention provides a sound signal processing method comprising: preparing a weighting factor dictionary containing a plurality of weighting factors associated with a plurality of characteristic quantities each representing a difference between multiple channel input sound signals; calculating an input sound signal difference between every few ones of multiple channel input sound signals to obtain a plurality of input characteristic quantities each indicating the input sound signal difference; selecting multiple weighting factors corresponding to the input characteristic quantities from the weighting factor dictionary; weighting the multiple channel input sound signals by using the selected weighting factors; and adding the weighted input sound signals to generate an output sound signal.

DETAILED DESCRIPTION OF THE INVENTION

Embodiments of the present invention will be described with reference to drawings.

First Embodiment

Figure 1:
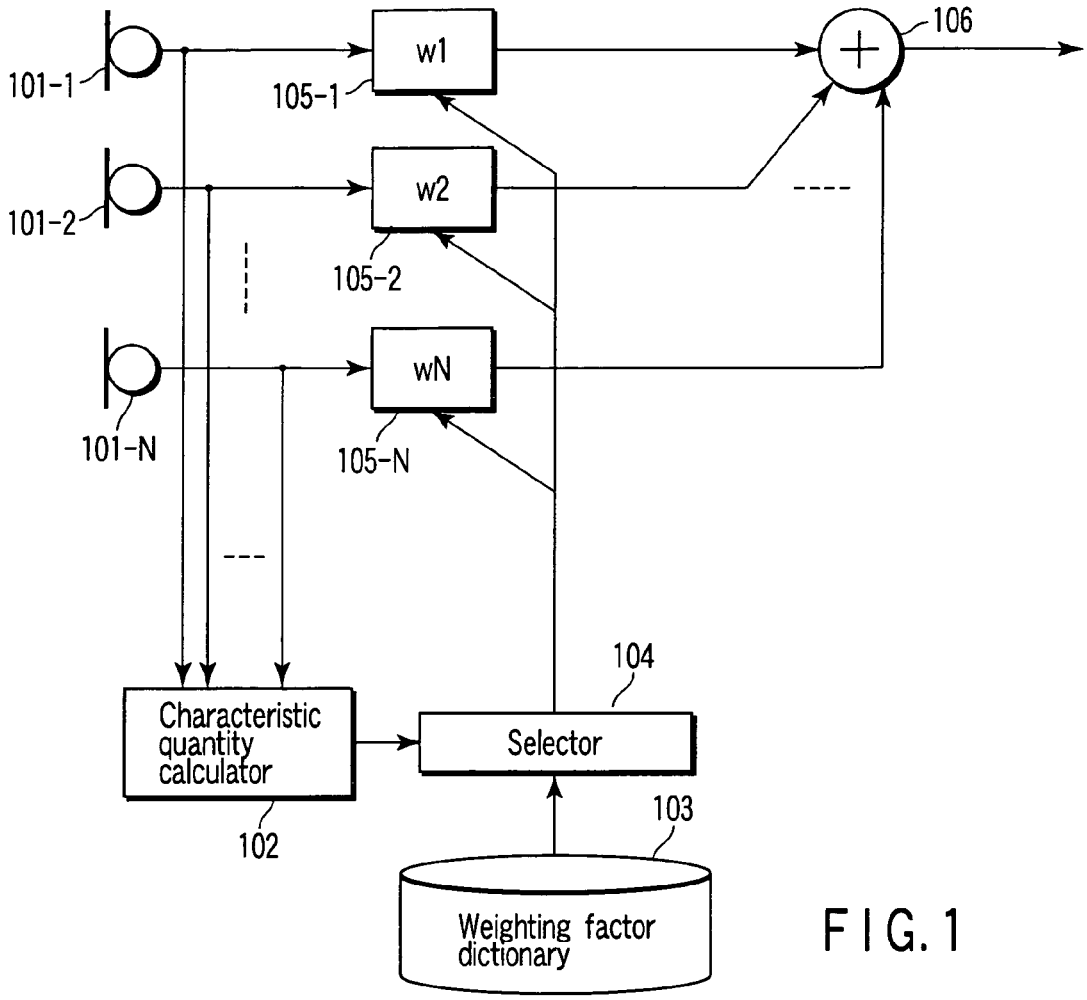
FIG. 1 is a block diagram of a sound signal processing apparatus concerning a first embodiment.

As shown in FIG. 1, the sound signal processing apparatus according to the first embodiment comprises a characteristic quantity calculator 102 to calculate a quantity of inter-channel characteristics of receive sound signals (input sound signals) of N-channels from a plurality of (N) microphones 101-1 to 101-N, a weighting factor dictionary 103 which stored a plurality of weighting factors, a selector 104 to select a weighting factor among the weighting factor dictionary 103 based on the quantity of inter-channel characteristics, a plurality of weighting units 105-1 to 105-N to weight the input sound signals x1 to xN by the selected weighting factor, and an adder to add the weighted output signals of the weighting units 105-1 to 105-N to output an emphasized output sound signal.

Figure 2:
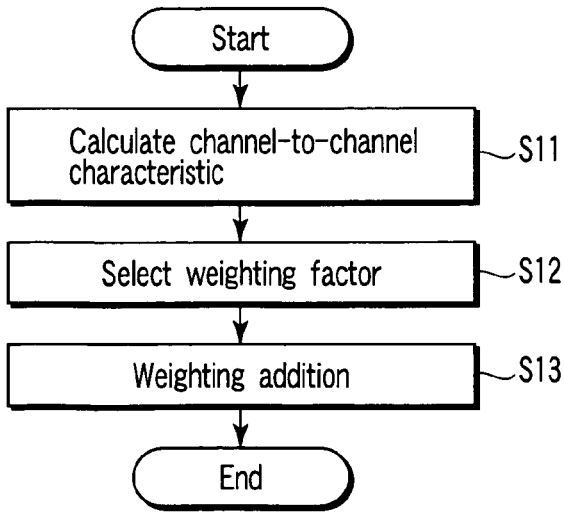
FIG. 2 is a flow chart which shows a processing procedure concerning the first embodiment.

The processing procedure of the present embodiment is explained according to the flow chart of FIG. 2.

The input sound signals x1 to xN from the microphones 101-1 to 101-N are input to the characteristic quantity calculator 102 to calculate a quantity of inter-channel characteristics (step S11). When a digital signal processing technology is used, the input sound signals x1 to xN are quantized in time direction with a AD converter which is not illustrated, and is expressed by x1(*t*) using, for example, a time index t. The inter-channel characteristic quantity is a quantity representing a difference between, for example, every two of the channels of the input sound signals x1 to xN, and is described concretely hereinafter. If the input sound signals x1 to xN are quantized, the inter-channel characteristic quantities are quantized, too.

The weighting factors w1 to wN corresponding to the inter-channel characteristic quantities are selected from the weighting factor dictionary 103 with the selector 104 according to the inter-channel characteristic quantities (step S12). The association of the inter-channel characteristic quantities with the weighting factors w1 . . . wN is determined beforehand. The simplest method is a method of associating the quantized inter-channel characteristic quantities with the quantized weighting factors w1 to wN one to one.

The method of associating the quantized inter-channel characteristic quantities with the quantized weighting factors w1 to wN more effectively is a method of grouping the inter-channel characteristic quantities using a clustering method such as LBG, and associating the weighting factors w1 with wN to the groups of inter-channel characteristic quantities as explained in the following third embodiment. In addition, a method of associating the weight of the distribution with the weighting factors w1 to wN using statistical distribution such as GMM (Gaussian mixture model) is considered. As thus described various methods for associating the inter-channel characteristic quantities with the weighting factors are considered, and a suitable method is determined in consideration with a computational complexity or quantity of memory.

The weighting factors w1 to wN selected with the selector 104 are set to the weighting units 105-1 to 105-N. After the input sound signals x1 to xN are weighted with the weighting units 105-1 to 105-N according to the weighting factors w1 to wN, they are added with the adder 106 to produce an output sound signal y wherein the target sound signal is emphasized (step S13).

In digital signal processing in a time domain, the weighting is expressed as convolution. In this case, the weighting factors w1 to wN are expressed as filter coefficients wn={wn(0), wn(1), . . . , wn(L−1)} n=1, 2, . . . , N, where if L is assumed to be a filter length, the output signal y is expressed as convolution sum of channels as expressed by the following equation (1):

$$y(t) = \sum_{n=1}^{N} (xn(t) * wn) \tag{1}$$

where * represents convolution and is expressed by the following equations (2):

$$xn(t) * wn = \sum_{k=0}^{L-1} (xn(t-k) * wn(k)) \tag{2}$$

The weighting factor wn is updated in units of one sample, one frame, etc.

The inter-channel characteristic quantity is described hereinafter. The inter-channel characteristic quantity is a quantity indicating a difference between, for example, every two of the input sound signals x1 to xN of N channels from N microphones 101-1 to 101-N. Various quantities are considered as described hereinafter.

Figure 3:
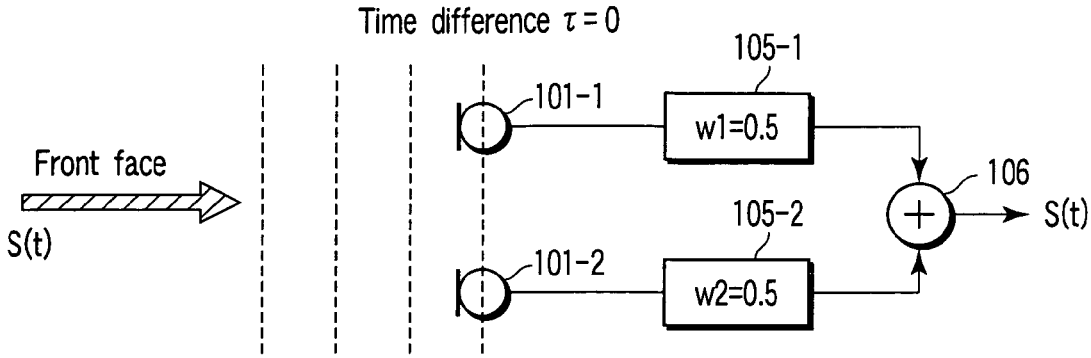
FIG. 3 is a diagram for explaining a method of setting a weighting factor in the first embodiment.
Figure 4:
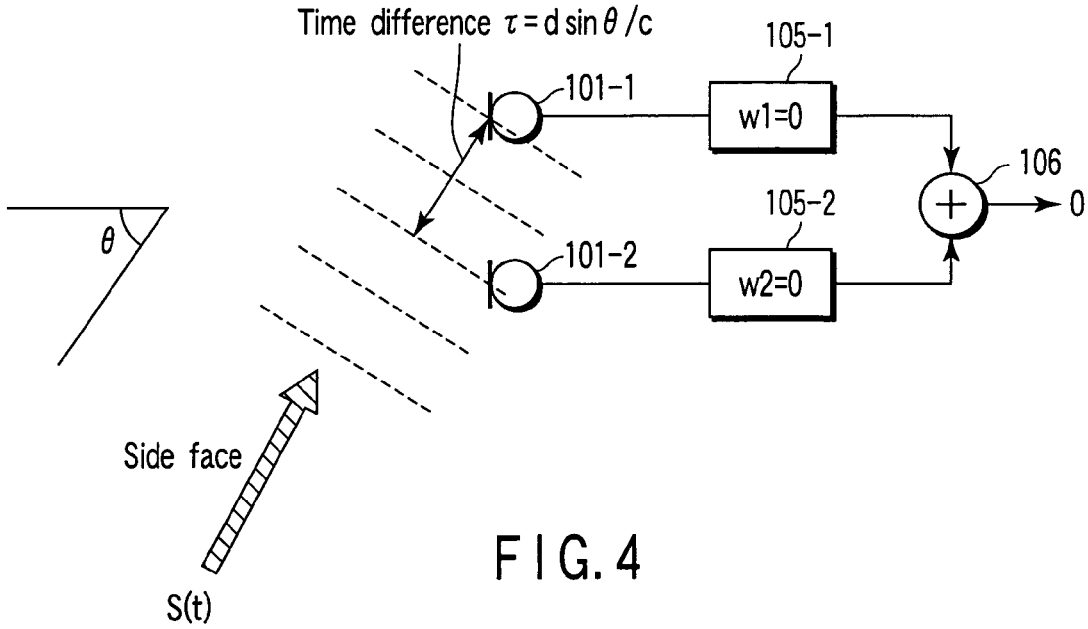
FIG. 4 is a diagram for explaining a method of setting a weighting factor in the first embodiment.

An arrival time difference τ between the input sound signals x1 to xN is considered when N=2. When the input sound signals x1 to xN come from the front of the array of microphones 101-1 to 101-N as shown in FIG. 3, τ=0. When the input sound signals x1 to xN come from the side that is shifted by angle θ with respect to the front of the microphone array as shown in FIG. 4, a delay of τ=d sin θ/c occurs, where c is a speed of sound, and d is a distance between the microphones 101-1 to 101-N.

If the arrival time difference τ can be detected, only the input sound signal from the front of the microphone array can be emphasized by associating the weighting factors that are larger relatively with respect to τ=0, for example, (0.5, 0.5) with the inter-channel characteristic quantities, and associating the weighting factors which are smaller relatively with respect to a value other than τ=0, for example, (0, 0) therewith. When τ is quantized, it may be set at a time corresponding to the minimum angle by which the array of microphones 101-1 to 101-N can detect the target speech. Alternatively, it may be set at a time corresponding to a constant angle unit of one degree, etc., or a constant time interval regardless of the angle, etc.

Many of microphone arrays used well conventionally generate an output signal by weighting input sound signals from respective microphones and adding weighted sound signals. There are various schemes of microphone array, but a difference between the schemes is a method of determining the weighting factor w fundamentally. Many adaptive microphone arrays obtain in analysis the weighting factor w based on the input sound signal. According to the DCMP (Directionally Constrained Minimization of Power) that is one of adaptive microphone arrays, the weighting factor w is expressed by the following equation (3):

$$w = \frac{inv(Rxx)c}{(c^h inv(Rxx)c)h} \tag{3}$$

where Rxx indicates an inter-channel correlation matrix of input sound signals, inv( ) indicates an inverse matrix, h indicates a conjugate transpose, w and c each indicate a vector, and h is a scalar. The vector c is referred to as a constraining vector. It is possible to design the apparatus so that the response of the direction indicated by the vector h becomes a desired response h. It is possible to set a plurality of constraining conditions. In this case, c is a matrix and h is a vector. Usually, the apparatus is designed setting the restriction vector at a target sound direction and the desired response at 1.

Since in DCMP the weighting factor is obtained adaptively based on the input sound signal from the microphone, it is possible to realize high noise suppression ability with the reduced number of microphones in comparison with a fixed model array such as a delay sum array. However, because the direction of the vector c determined beforehand does not always coincide with the direction from which the target sound comes actually due to an interference of a sound wave under the reverberation, a problem of "target signal cancellation" that the target sound signal is considered to be a noise and is suppressed occurs. As thus described, the adaptation type array to form a directional characteristic adaptively based on the input sound signal is influenced the reverberation remarkably, and thus a problem of "target signal cancellation" is not avoided.

In contrast, a method of setting the weighting factor based on inter-channel characteristic quantity according to the present embodiment can restrain the target signal cancellation by learning the weighting factor. Assuming that an sound signal emitted at the front of the microphone array delays by $\tau 0$ with respect to the arrival time difference $\tau$ due to reflection from an obstacle, it is possible to avoid a problem of target signal cancellation by increasing the weighting factor corresponding to $\tau 0$ relatively to have (0.5, 0.5), and decreasing the weighting factor corresponding to $\tau$ aside from $\tau 0$ relatively to have (0, 0). Learning of weighting factor, namely association of the inter-channel characteristic quantities with the weighting factors when the weighting factor dictionary 103 is made is done beforehand by a method described hereinafter.

For example, a CSP (cross-power-spectrum phase) method can be offered as a method for obtaining the arrival time difference $\tau$. In the case that N=2 in the CSP method, a CSP coefficient is calculated by the following equation (4):

$$CSP(t) = IFT\frac{conj(X1(f)) \times X2(f)}{|X1(f)| \times |X2(f)|} \tag{4}$$

CSP(t) indicates the CSP coefficient, Xn(f) indicates a Fourier transform of xn(t), IFT{ } indicates a inverse Fourier transform, conj( ) indicates a complex conjugate, and | | indicates an absolute value. The CSP coefficient is obtained by a inverse Fourier transform of whitening cross spectrum, a pulse-shaped peak is obtained at a time t corresponding to the arrival time difference $\tau$. Therefore, the arrival time difference $\tau$ can be known by searching for the maximum of the CSP coefficient.

The inter-channel characteristic quantity based on the arrival time difference can use complex coherence other than the arrival time difference. The complex coherence of X1(*f*), X2(*f*) is expressed by the following equation (5):

$$Coh(f) = \frac{E\{conj(X1(f)) \times X2(f)\}}{\sqrt{E\{|X1(f)|^2\} \times E\{|X2(f)|^2\}}} \tag{5}$$

where Coh(f) is complex coherence, and E{ } is expectation of a time direction. The coherence is used as a quantity indicating relation of two signals in a field of signal processing. The signal without correlation between channels such as diffusive noise decreases in absolute value of coherence, and the directional signal increases in coherence. Because in the directional signal a time difference between channels emerges as a phase component of coherence, the directional signal can be distinguished by a phase whether it is a signal from a target sound direction or a signal from a direction aside from the direction. The diffusive noise, target sound signal and directional noise can be distinguished by using these characters as the characteristic quantity. Since coherence is a function of frequency as understood from equation (5), it is well-matched with the second embodiment. However, when it is used in a time domain, various methods of averaging it in the time direction and using a value of representative frequency and so on are conceivable. The coherence is generally defined by the N-channel, but is not limited to N=2 such as the example described above.

A generalized correlation function as well as the characteristic quantity based on the arrival time difference may be used for the inter-channel characteristic quantity. The generalized correlation function is described by, for example, "The Generalized Correlation Method for Estimation of Time Delay, C. H. Knapp and G. C. Carter, IEEE Trans, Acoust., Speech, Signal Processing", Vol. ASSP-24, No. 4, pp. 320-327 (1976). The generalized correlation function GCC(t) is defined by the following equation (6):

$$GCC(t)=IFT\{\Phi(f)\times G12(f)\} \tag{6}$$

where IFT is inverse Fourier transform, $\Phi$(f) is a weighting factor, G12(*f*) is a cross power spectrum between channels. There is various methods for determining $\Phi$(f) as described in the above documents. The weighting factor $\Phi$ml(f) based on, for example, the maximum likelihood estimation method is expressed by the following equation (7):

$$\Phi m1(f) = \frac{1}{|G12(f)|} \times \frac{|\gamma 12(f)|^2}{1 - |\gamma 12(f)|^2} \tag{7}$$

where $|\gamma 12(f)|^2$ is amplitude square coherence. It is similar to CSP that the strength of correlation between channels and a direction of a sound source can be known from the maximum of GCC(t) and t giving the maximum.

As thus described, even if direction information of the input sound signals x1 to xN is disturbed by the reverberation, the target sound signal can be emphasized without the problem of "target signal cancellation" by learning relation of the inter-channel characteristic quantity and weighting factors w1 to wN.

Second Embodiment

Figure 5:
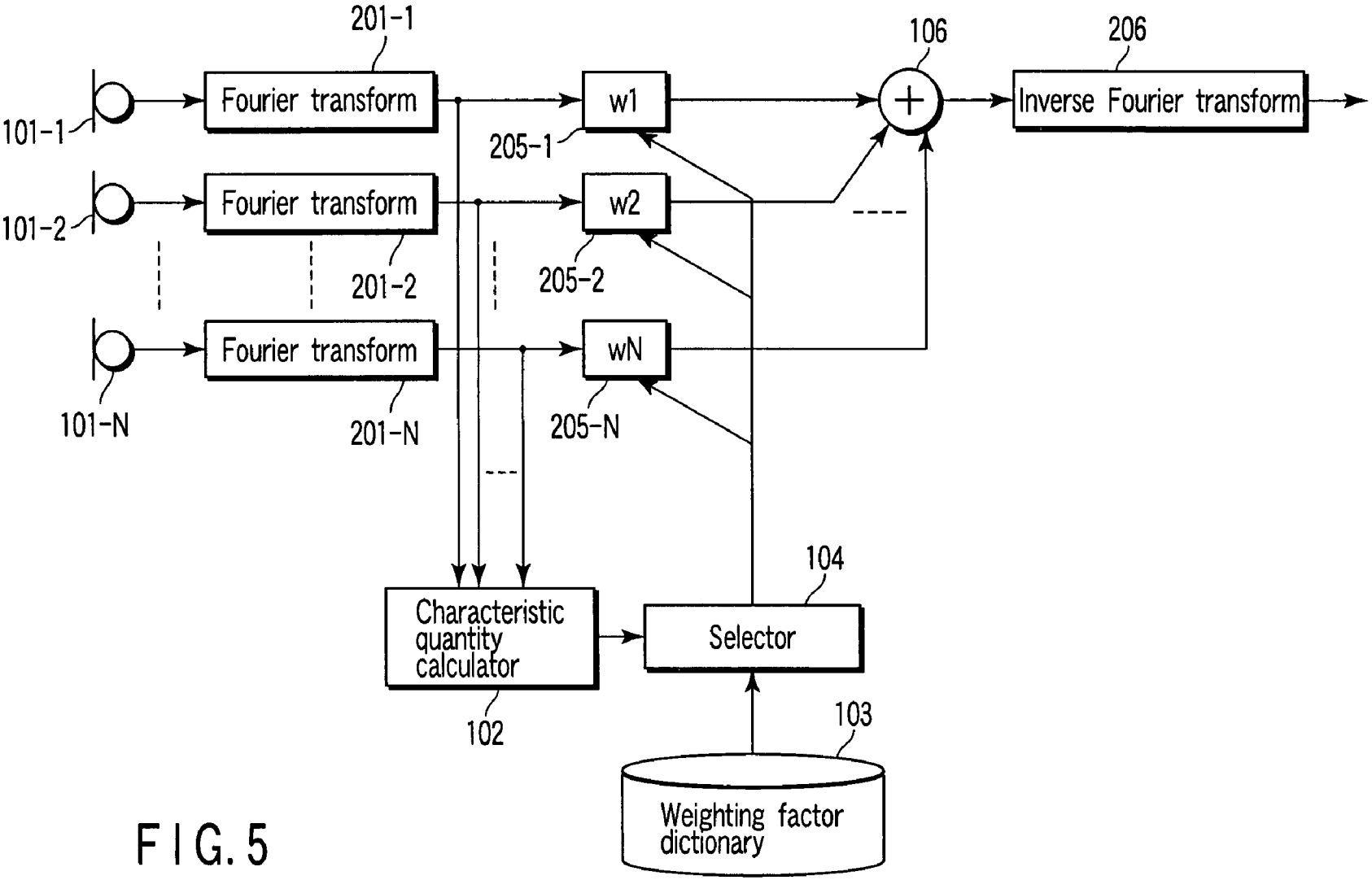
FIG. 5 is a block diagram of a sound signal processing apparatus concerning a second embodiment.

In the present embodiment shown in FIG. 5, Fourier transformers 201-1 to 201-N and an inverse Fourier transformer 207 are added to the sound processing apparatus of the first embodiment shown in FIG. 1, and further the weighting units 105-1 to 105-N of FIG. 1 are replaced with weighting units 205-1 to 205-N to perform multiplication in a frequency domain. Convolution operation in a time domain is expressed by a product in a frequency domain as is known in a field of digital signal processing technology. In the present embodiment, the weighting addition is done after the input sound signals x1 to xN have been transformed to signal components of the frequency domain by the Fourier transformers 201-1 to 201-N. Thereafter, the inverse Fourier transformer 205 subjects the transformed signal components to inverse Fourier transform to bring back to signals of time domain, and generate an output sound signal. The second embodiment performs signal processing equivalent to the first embodiment for executing signal processing in a time domain. The output signal of an adder 106 which corresponds to the equation (1) is expressed in a form of product rather than convolution as the following equation (8):

$$Y(k) = \sum_{n=1}^{N} (Xn(k) \times Wn(k)) \tag{8}$$

where k is a frequency index.

An output sound signal y(t) having a waveform of time domain is generated by subjecting the output signal Y(k) of the adder 106 to inverse Fourier transform. Advantages obtained by transforming the sound signal into a frequency domain in this way are to reduce computational amount according to weighting factors of weighting units 105-1 to 105ˆ-N and to express the complicated reverberation in easy because the sound signals can be independently processed in units of frequency. Supplementing about the latter, generally, interference of a waveform due to the reverberation differs in strength and phase every frequency. In other words, the sound signal varies strictly in a frequency direction. More specifically, the sound signal is interfered by reverberation in strong at a certain frequency, but is not much influenced by reverberation at another frequency. In such instances, it is desirable to process the sound signals independently every frequency to permit accurate processing. A plurality of frequencies may be bundled according to convenience of computational complexity to process the sound signals in units of subband.

Third Embodiment

Figure 6:
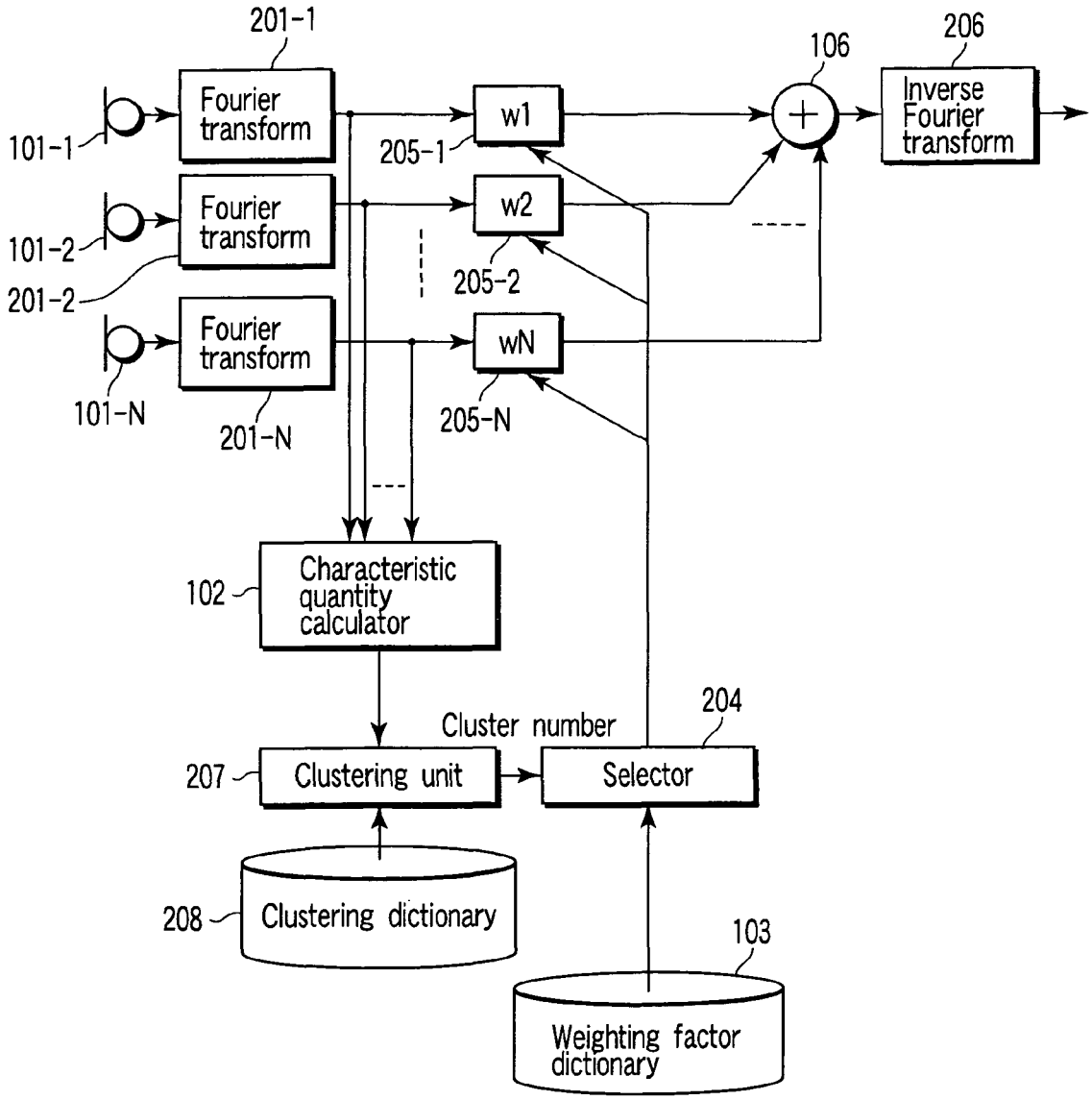
FIG. 6 is a block diagram of a sound signal processing apparatus concerning a third embodiment.

In the third embodiment, a clustering unit 208 and a clustering dictionary 209 are added to the sound signal processing apparatus of the second embodiment of FIG. 5 as shown in FIG. 6. The clustering dictionary 209 stores I centroids provided by a LBG method.

Figure 7:
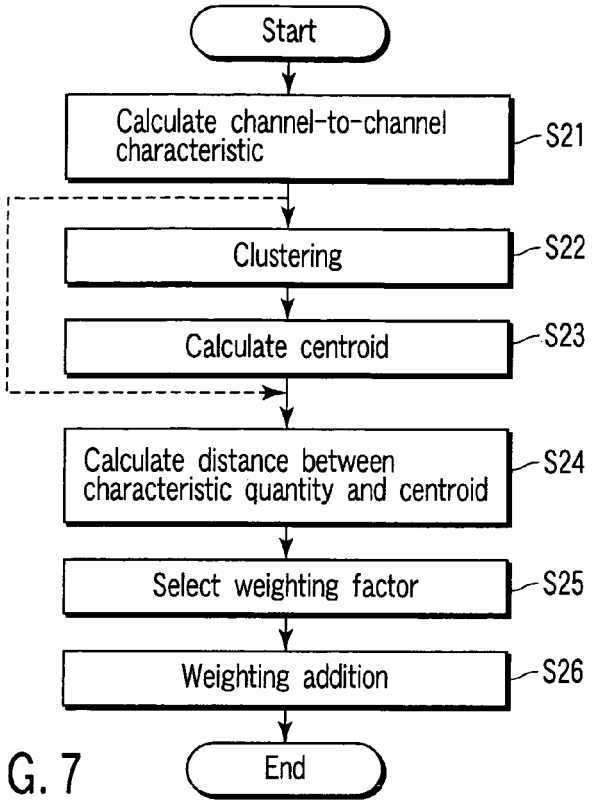
FIG. 7 is a flow chart which shows a processing procedure concerning the third embodiment.

As shown in FIG. 7, at first the input sound signals x1 to xN from the microphones 101-1 to 101-N are transformed to a frequency domain with the Fourier transformers 205-1 to 205-N like the second embodiment, and then the inter-channel characteristic quantity is calculated with the inter-channel characteristic quantity calculator 102 (step S21).

The clustering unit 208 clusters the inter-channel characteristic quantity referring to the clustering dictionary 209 to generate a plurality of clusters (step S22). The centroid (center of gravity) of each cluster, namely a representative point is calculated (step S23). A distance between the calculated centroid and the I centroids in the clustering dictionary 209 is calculated (step S24).

The clustering unit 208 sends an index number indicating a centroid making the calculated distance minimum (a representative that the distance becomes minimum) to a selector 204. The selector 204 selects weighting factors corresponding to the index number from the weighting factor dictionary 103, and sends them to the weighting units 105-1 to 105-N (step S25).

The input sound signals transformed to a frequency domain with the Fourier transformers 205-1 to 205-N are weighted by the weighting factor with the weighting units 105-1 to 105-N, and added with the adder 206 (step S26). Thereafter, the inverse Fourier transformer 207 transforms the weighted addition signal into a waveform of time domain to generate an output sound signal in which a target speech signal is emphasized. When it generates a centroid dictionary in advance by processing separately S22 and S23 from other steps, it processes in order of S21, S24, S25, and S26.

A method for making the weighting factor dictionary 103 by learning is described. The inter-channel characteristic quantity has a certain distribution every sound source position or every analysis frame. Since the distribution is continuous, it is necessary to associate the inter-channel characteristic quantities with the weighting factors to be quantized. Although there are various methods for associating the inter-channel characteristic quantities with the weighting factors, a method of clustering the inter-channel characteristic quantities according to a LBG algorithm beforehand, and associating the weighting factors with the number of the cluster having a centroid making a distance with respect to the inter-channel characteristic quantity minimum. In other words, the mean value of the inter-channel characteristic quantities is calculated every cluster and one weighting factor corresponds to each cluster.

When making the clustering dictionary 209, a series of sounds emitted from a sound source while changing the position of the sound source under assumed reverberation environment are received with the microphones 101-1 to 101-N, and inter-channel characteristic quantities about N-channel learning input sound signals from the microphones are calculated as described above. The LBG algorithm is applied to the inter-channel characteristic quantities. Subsequently, the weighting factor dictionary 103 corresponding to the cluster is made as follows.

Relation of the input sound signal and output sound signal in frequency domain is expressed by the following equation (9):

$$Y(k)=X(k)^h \times W(k) \tag{9}$$

where X(k) is a vector of X(k)={X1(*k*), X2(*k*), . . . , XN (k)}, and W(k) is a vector formed of the weighting factor of each channel. k is a frequency index, and h express a conjugate transpose.

Assuming that the learning input sound signal of the m-th frame from the microphone is X(m, k), an output sound signal obtained by weighting and adding the learning input sound signals X(m, k) according to the weighting factor is Y(m, k), and a target signal, namely desirable Y(m, k) is S(m, k). These X(m, k), Y(m, k) and S(m, k) are assumed to be learning data of the m-th frame. The frequency index k is abbreviated hereinafter.

The number of all frames of the learning data generated in various environments such as different positions is assumed to be M, and a frame index is assigned to each frame. The inter-channel characteristic quantities of the learning input sound signals are clustered, and a set of frame indexes belonging to the i-th cluster is represented by Ci. An error with respect to the target signal of the output sound signal of the learning data which belongs to the i-th cluster is calculated. This error is a total sum Ji of squared errors of the target signal with respect to the output sound signal of the learning data which belongs to, for example, the i-th cluster, and expressed by the following equation (10):

$$Ji = \sum_{i \in Ci} (X(m)^h \times W - S(m))^2 \quad (10)$$

wi minimizing Ji of the equation (10) is assumed to be a weighting factor corresponding to the i-th cluster. The weighting factor wi is obtained by subjecting Ji to partial differentiation with w. In other words, it is expressed by the following equation (11):

$$Wi = inv(Rxx)P \quad (11)$$

where $$Rxx = E\{X(m)X(m)^h\}$$

$$P = E\{S\,X(m)\} \quad (12)$$

where, E{ } expresses an expectation.

This is done for all clusters, and Wi (i=1, 2, i . . . , I) is recorded in the weighting factor dictionary 103, were, I is a total sum of clusters.

The association of the inter-channel characteristic quantities with the weighting factors may be performed by any method such as GMM using statistical technique, and is not limited to the present embodiment. The present embodiment describes a method of setting the weighting factor in the frequency domain. However, it is possible to set the weighting factor in the time domain.

Fourth Embodiment

Figure 8:
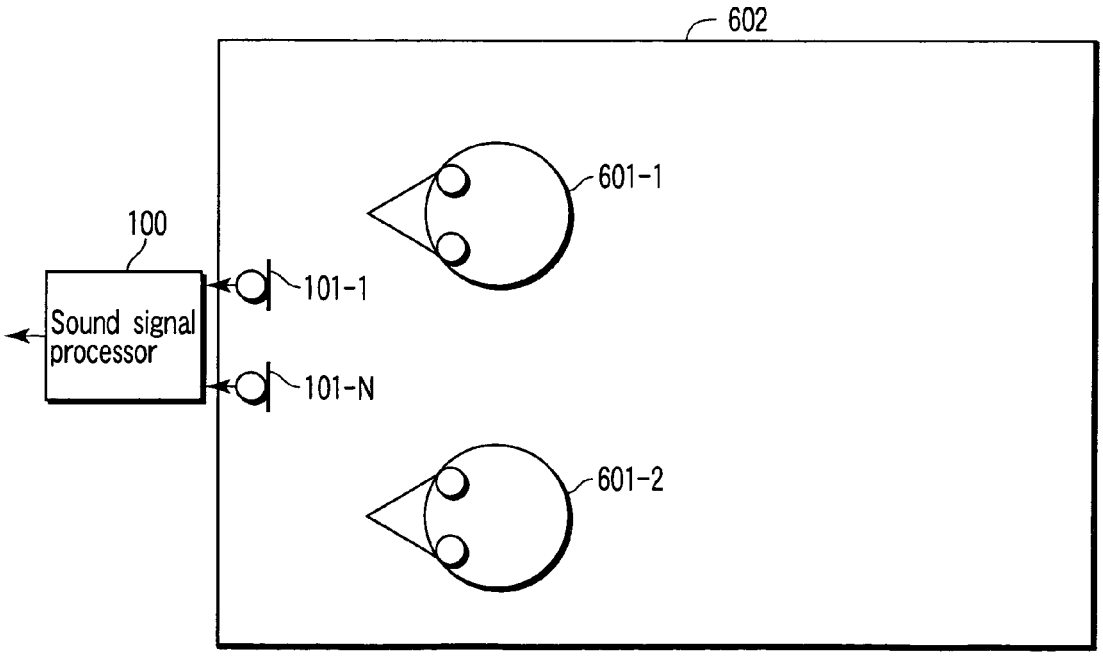
FIG. 8 is a schematic plane view of a system using a sound signal processing apparatus according to a fourth embodiment.

In the fourth embodiment, the microphones 101-1 to 101-N and the sound signal processing apparatus 100 described in any one of the first to third embodiments are arranged in the room 602 in which the speakers 601-1 and 601-2 present as shown in FIG. 8. The room 602 is the inside of a car, for example. The sound signal processing apparatus 603 sets a target sound direction in a direction of the speaker 601-1, and a weighting factor dictionary is made by executing the learning described in the third embodiment in the environment equivalent to or relatively similar to the room 602. Therefore, the utterance of the speaker 601-1 is not suppressed, and only utterance of the speaker 601-2 is suppressed.

In fact, there are variable factors such as changes relative to a sound source such as a seating position of a person, a figure thereof and a position of a seat of a car, loads loaded into a car, and opening and closing of a window. At the time of learning, learning is done with these variable factors being included in learning data, and the apparatus is designed to be robust against the variable factors. However, it is conceivable that additional learning is done when optimizing to the situation. The clustering dictionary and weighting factor dictionary (not shown) which are included in the sound signal processing apparatus 100 are updated based on some utters emitted by the speaker 601-1. Similarly, it is possible to update the dictionary so as to suppress the speech emitted by the speaker 601-2.

Fifth Embodiment

Figure 9:
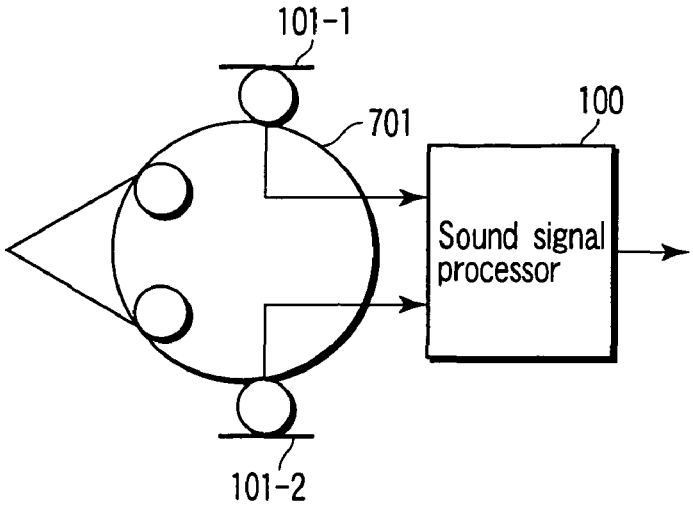
FIG. 9 is a schematic plane view of a system using a sound signal processing apparatus according to a fifth embodiment.

According to the fifth embodiment, the microphones 101-1 and 101-2 are disposed on both sides of robot head 701, namely ears thereof as shown in FIG. 9, and connected to the sound signal processing apparatus 100 explained in any one of the first to third embodiments.

As thus described, in the microphones 101-1 and 101-2 provided on the robot head 701, the direction information of the sound arriving similarly to the reverberation is disturbed by diffraction of a complicated sound wave on the head 701. In other words, in this way when the microphones 101-1 and 101-2 are arranged on the robot head 701, the robot head 701 becomes an obstacle on a straight line connecting the microphones and the sound source. For example, when the sound source exists on the left hand side of the robot head 701, the sound arrives at directly the microphone 101-2 which is located on the left ear, but it does not arrive at directly the microphone 101-1 which is located on the right ear because the robot head 701 becomes an obstacle, and the diffraction wave that propagates around the head 701 arrives at the microphone.

It takes trouble to analyze influence of such a diffraction mathematically. For this reason, in the case that the microphones are arranged with sandwiching the ears of the robot head 701 as shown in FIG. 9 or an obstacles such as a pillar or a wall, the obstacle between the microphones complicates an estimate in a sound source direction.

According to the first to third embodiments, even if there is an obstacle on a straight line connecting the microphone and the sound source, it becomes possible to emphasize only the target sound signal from a specific direction by learning influence of diffraction due to the obstacle and incorporating it into the sound signal processing apparatus.

Sixth Embodiment

Figure 10:
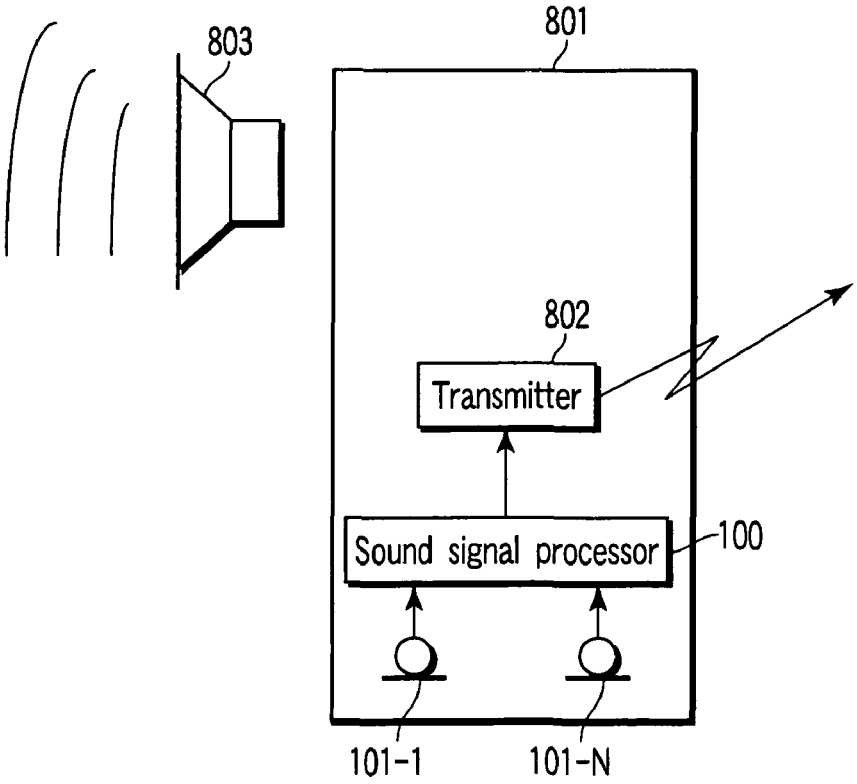
FIG. 10 is a block diagram of an echo canceller using a sound signal processing apparatus according to a sixth embodiment.

FIG. 10 shows an echo canceller according to the sixth embodiment. The echo canceller comprises microphones 101-1 to 101-N, an acoustic signal processing apparatus 100 and a transmitter 802 which are disposed in a room 801 such as a car and a speaker 803. There is a problem that the component (echo) of a sound emitted from the loud speaker 803 which gets into the microphones 101-1 to 101-N from the loud speaker is sent to a caller, when a hands-free call is done with a telephone, a personal digital assistant (PDA), a personal computer (PC) or the like. The echo canceller is generally used to prevent this.

In the present embodiment, a characteristic that the sound signal processing apparatus 100 can form directivity by learning is utilized, and a sound signal emitted from the loud speaker 803 is suppressed by learning beforehand that it is not a target signal. Simultaneously, the voice of the speaker is passed by learning to pass the sound signal from the front of the microphone, whereby the sound from the loud speaker 803 can be suppressed. If this principle is applied, it can be learned to suppress music from a loud speaker in a car, for example.

The sound signal processing explained in the first to sixth embodiments can be realized by using, for example, a general purpose computer as basis hardware. In other words, the sound signal processing can be realized by making a processor built in the computer carry out a program. It may be realized by installing the program in the computer beforehand. Alternatively, the program may be installed in the computer appropriately by storing the program in a storage medium such as compact disk-read only memory or distributing the program through a network.

According to the present invention, the problem of the target signal cancellation due to a reverberation can be avoided by learning weighting factors easily to select a weighting factor based on the inter-channel characteristic quantity of a plurality of input sound signals. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sound signal processing method, comprising:

preparing a weighting factor dictionary containing a plurality of weighting factors associated with a plurality of characteristic quantities each representing a difference between multiple channel input sound signals;

calculating an input sound signal difference between multiple channel input sound signals to obtain a plurality of input characteristic quantities each indicating the input sound signal difference;

selecting multiple weighting factors corresponding to the input characteristic quantities from the weighting factor dictionary;

weighting the multiple channel input sound signals by using the selected weighting factors; and adding the weighted input sound signals to generate an output sound signal.

2. The method according to claim 1, wherein obtaining the plural characteristic quantities includes obtaining the characteristic quantities based on an arrival time difference between channels of the multiple channel input sound signals.

3. The method according to claim 1, wherein obtaining the plural characteristic quantities includes calculating complex coherence between channels of the multiple channel input sound signals.

4. The method according to claim 1, further comprising generating the multiple channel input sound signals from a plurality of microphones with an obstacle being arranged between a sound source and the microphones.

5. The method according to claim 1, wherein the weighting factor dictionary contains the weighting factors determined to suppress a signal from a loud speaker.

6. The method according to claim 1, wherein the weighting factors correspond to filter coefficients of a time domain, and weighting to the multiple channel input sound signal is represented by convolution of the multiple channel input sound signal and the weighting factor.

7. The method according to claim 1, wherein the weighting factors correspond to filter coefficients of a frequency domain, and weighting to the multiple channel input sound signal is represented by a product of the multiple channel input sound signal and the weighting factor.

8. A sound signal processing method, comprising:

preparing a weighting factor dictionary containing a plurality of weighting factors associated with a plurality of characteristic quantities each representing a difference between multiple channel input sound signals;

calculating an input sound signal difference between multiple channel input sound signals to obtain a plurality of input characteristic quantities each indicating the difference;

clustering the input characteristic quantities to generate a plurality of clusters;

calculating a centroid of each of the clusters;

calculating a distance between each of the input characteristic quantities and the centroid to obtain a plurality of distances;

selecting, from the weighting factor dictionary, weighting factors corresponding to one of the clusters that has a centroid making the distance minimum;

weighting the multiple channel input sound signals by the selected weighting factors; and adding the weighted multiple channel input sound signals to generate an output sound signal.

9. The method according to claim 8, wherein obtaining the plural characteristic quantities includes obtaining characteristic quantities based on an arrival time difference between channels of the multiple channel input sound signals.

10. The method according to claim 8, wherein obtaining the plural characteristic quantities includes calculating complex coherence between channels of the multiple channel input sound signals.

11. The method according to claim 8, further comprising:

calculating a difference between channels of multiple channel second input sound signals to obtain a plurality of second characteristic quantities each indicating the difference, the multiple channel second input sound signals being obtained by receiving with microphones a series of sounds emitted from a sound source while changing a learning position;

clustering the second characteristic quantities to generate a plurality of second clusters;

weighting the multiple channel second input sound signals corresponding to each of the second clusters by second weighting factors of the weighting factor dictionary;

adding the weighted multiple channel second input sound signals to generate a second output sound signal; and recording in the weighting factor dictionary a weighting factor of the second weighting factors that make an error of the second output sound signal with respect to a target signal minimum.

12. The method according claim 8, further comprising generating the multiple channel input sound signals from a plurality of microphones with an obstacle being arranged between a sound source and the microphones.

13. The method according to claim 8, wherein the weighting factor dictionary contains the weighting factors determined to suppress a signal from a loud speaker.

14. The method according to claim 8, wherein the weighting factors correspond to filter coefficients of a time domain, and weighting to the multiple channel input sound signal is represented by convolution of the multiple channel input sound signal and the weighting factor.

15. The method according to claim 8, wherein the weighting factors correspond to filter coefficients of a frequency domain, and weighting to the multiple channel input sound signal is represented by a product of the multiple channel input sound signal and the weighting factor.

16. A sound signal processing method, comprising:

preparing a weighting factor dictionary containing a plurality of weighting factors associated with a plurality of characteristic quantities each representing a difference between multiple channel input sound signals;

calculating an input sound signal difference between multiple channel input sound signals to obtain a plurality of input characteristic quantities each indicating the input sound signal difference;

calculating a distance between each of the input characteristic quantities and each of a plurality of representatives prepared beforehand;

determining a representative at which the distance becomes minimum;

selecting multiple channel weighting factors corresponding to the determined representative from the weighting factor dictionary;

weighting the multiple channel input sound signals by the selected weighting factor; and adding the weighted multiple channel input sound signals to generate an output sound signal.

17. The method according to claim 16, wherein obtaining the plural characteristic quantities includes obtaining a characteristic quantity based on an arrival time difference between channels of the multiple channel input sound signals.

18. The method according to claim 16, wherein obtaining the plural characteristic quantities includes calculating complex coherence between channels of the multiple channel input sound signals.

19. The method according to claim 16, further comprising generating the multiple channel input sound signals from a plurality of microphones with an obstacle being arranged between a sound source and the microphones.

20. The method according to claim 16, wherein the weighting factor dictionary contains the weighting factors determined to suppress a signal from a loud speaker.

21. The method according to claim 16, wherein the weighting factors correspond to filter coefficients of a time domain, and weighting to the multiple channel input sound signal is represented by convolution of the multiple channel input sound signal and the weighting factor.

22. The method according to claim 16, wherein the weighting factors correspond to filter coefficients of a frequency domain, and weighting to the multiple channel input sound signal is represented by a product of the multiple channel input sound signal and the weighting factor.

23. A sound signal processing apparatus, comprising:

a weighting factor dictionary containing a plurality of weighting factors associated with a plurality of characteristic quantities each representing a difference between multiple channel input sound signals;

a calculator to calculate an input sound signal difference between multiple channel input sound signals to obtain a plurality of characteristic quantities each representing the input sound signal difference;

a selector to select multiple channel weighting factors corresponding to the characteristic quantities from the weighting factor dictionary; and a weighting-adding unit configured to weight the multiple channel input sound signals by the selected weighting factors and add the weighted multiple channel input sound signals to generate an output sound signal.

24. An acoustic signal processing apparatus, comprising:

a weighting factor dictionary containing a plurality of weighting factors associated with a plurality of characteristic quantities each representing a difference between multiple channel input sound signals;

a calculator to calculate an input sound signal difference between a plurality of the multiple channel input sound signals to obtain a plurality of characteristic quantities each representing the input sound signal difference;

a clustering unit configured to cluster the characteristic quantities to generate a plurality of clusters;

a selector to select multiple channel weighting factors corresponding to one of the clusters that has a centroid indicating a minimum distance with respect to the characteristic quantity from the weighting factor dictionary; and a weighting-adding unit configured to weight the multiple channel input sound signal using the selected weighting factors to generate an output sound signal.

25. A non-transitory computer readable storage medium storing instructions of a computer program that, when executed by a computer, causes the computer to perform the steps of:

calculating a difference between a plurality of multiple channel input sound signals to obtain plural characteristic quantities each indicating a distance;

selecting a weighting factor from a weighting factor dictionary preparing plural weighting factors associated with the characteristic quantities beforehand; and weighting the multiple channel input sound signals by using the selected weighting factor and adding the weighted multiple channel input sound signals to generate an output sound signal.

26. A non-transitory computer readable storage medium storing instructions of a computer program that, when executed by a computer, causes the computer to perform the steps of:

calculating a difference between a plurality of multiple channel input sound signals to obtain plural characteristic quantities each indicating a distance;

clustering the characteristic quantities to generate plural clusters;

calculating a centroid of each of the clusters;

calculating a distance between each of the characteristic quantities and the centroid to obtain plural distances;

selecting multiple channel weighting factors corresponding to one of the clusters that has the centroid indicating a minimum distance with respect to the characteristic quantity from a weighting factor dictionary prepared beforehand; and weighting the multiple channel input sound signals by the selected weighting factor and adding the weighted multiple channel input sound signals to generate an output sound signal.

27. The method according to claim 1, wherein the step of calculating an input sound signal difference between the multiple channel input sound signals includes calculating an input sound signal difference between every two or more of the multiple channel input sound signals.

28. The method according to claim 8, wherein the step of calculating an input sound signal difference between the input multiple channel input sound signals includes calculating an input sound signal difference between every two or more of the multiple channel input sound signals.

29. The method according to claim 16, wherein the step of calculating an input sound signal difference between the input multiple channel input sound signals includes calculating an input sound signal difference between every two or more of the multiple channel input sound signals.

30. The apparatus according to claim 23, wherein the calculator calculates an input sound signal difference between every two or more of the multiple channel input sound signals.

31. The apparatus according to claim 24, wherein the calculator calculates an input sound signal difference between every two or more of the multiple channel input sound signals.

32. The computer readable storage medium according to claim 25, wherein the step of calculating the difference between the plurality of multiple channel input sound signals includes calculating a difference between every two or more of the multiple channel input sound signals.

33. The computer readable storage medium according to claim 26, wherein the step of calculating the difference between the plurality of multiple channel input sound signals includes calculating a difference between every two or more of the multiple channel input sound signals.

* * * * *